United States Patent [19]

Komossa et al.

[11] Patent Number: 4,485,827

[45] Date of Patent: Dec. 4, 1984

[54] APPARATUS FOR RECOVERING TOBACCO FROM UNSATISFACTORY CIGARETTES OR THE LIKE

[75] Inventors: Werner Komossa, Börnsen; Hans-Adolf Barck, Dassesdorf; Thomas Bahr, Glinde, all of Fed. Rep. of Germany

[73] Assignee: Hauni-Werke Körber & Co. KG, Hamburg, Fed. Rep. of Germany

[21] Appl. No.: 425,488

[22] Filed: Sep. 28, 1982

[30] Foreign Application Priority Data

Jan. 28, 1982 [DE] Fed. Rep. of Germany ..... 3202698

[51] Int. Cl.[3] ..... A24C 5/36; A24C 5/34; A24C 5/18

[52] U.S. Cl. ..... 131/84 C; 131/96

[58] Field of Search ..... 131/96, 84 C; 83/62, 83/62.1

[56] References Cited

U.S. PATENT DOCUMENTS

| | | | |
|---|---|---|---|
| 3,255,762 | 6/1966 | Baier | 131/96 |
| 3,843,871 | 10/1974 | Fujimaki et al. | 83/62.1 |
| 4,236,534 | 12/1980 | Heitmann et al. | 131/84 C |
| 4,355,555 | 10/1982 | Kobayashi | 83/62.1 |

*Primary Examiner*—V. Millin
*Assistant Examiner*—Greg Beaucage
*Attorney, Agent, or Firm*—Peter K. Kontler

[57] ABSTRACT

Apparatus for recovering tobacco particles from unsatisfactory filter cigarettes has a rotary centrifugal aligning device which converts randomly supplied unsatisfactory cigarettes into a single file and transports successive cigarettes of the file past the peripheral surfaces of two rotary disc-shaped wrapper-engaging implements serving to break the wrappers and thus expose the tobacco-containing fillers for segregation from the wrappers and filters. The marginal portions of the implements are monitored by discrete photocells which generate signals on detection of cracks, chipping and/or other defects of the implements, and such signals are used to arrest the drive for the aligning device and for the implements. The interior of the aligning device is monitored by one or more detectors which generate signals denoting the quantity of unsatisfactory cigarettes in selected portions of the aligning device; such signals are used to interrupt the feed of unsatisfactory cigarettes to the aligning device when the detected quantity or quantities are outside of a preselected range.

11 Claims, 4 Drawing Figures

APPARATUS FOR RECOVERING TOBACCO FROM UNSATISFACTORY CIGARETTES OR THE LIKE

CROSS-REFERENCE TO RELATED CASE

The apparatus of the present invention constitutes an improvement over and a further development of the apparatus which is disclosed in commonly owned U.S. Pat. No. 3,255,762 granted June 14, 1966 to Anton Baier. The disclosure of this patent is incorporated herein by reference.

BACKGROUND OF THE INVENTION

The present invention relates to apparatus for manipulating plain or filter cigarettes, cigars, cigarillos, cheroots and analogous rod-shaped articles of the tobacco-processing industry. More particularly, the invention relates to improvements in apparatus for recovering natural, reconstituted and/or artificial tobacco from unsatisfactory and/or potentially unsatisfactory rod-shaped articles wherein one or more rod-shaped fillers of tobacco are surrounded by one or more tubular wrappers consisting of cigarette paper, imitation cork, sheets of reconstituted tobacco or other suitable wrapping material. Still more particularly, the invention relates to improvements in apparatus wherein a rotary centrifugal aligning device or an analogous means converts a supply of randomly distributed unsatisfactory or potentially unsatisfactory tobacco-containing rod-shaped articles (hereinafter referred to as unsatisfactory cigarettes with the understanding, however, that this term is to embrace unsatisfactory or potentially unsatisfactory plain or filter cigarettes, cigars, cigarillos, papyrossi and/or cheroots) into a file which is transported past one or more mobile wrapper-breaking implements serving to open up or break the wrappers lengthwise preparatory to segregation of tobacco particles from wrapping material, filters and/or other constituents of unsatisfactory cigarettes.

Commonly owned U.S. Pat. No. 3,255,762 to Baier discloses an apparatus wherein two peripherally toothed rotary disc-shaped implements are disposed in two mutually inclined planes and their marginal portions cooperate to break up the wrappers of successive unsatisfactory cigarettes which are caused to form a file under the action of a rotary centrifugal aligning device.

The making of cigarettes invariably involves the production of a certain minor percentage of unsatisfactory or potentially unsatisfactory cigarettes which are segregated from satisfactory products and are thereupon treated for the purpose of recovering the particles of tobacco for reintroduction into a cigarette maker or for admission into a machine for the making of reconstituted tobacco. As a rule, the recovery involves opening up the wrappers so as to enable a sifting or another suitable classifying device to segregate the thus freed tobacco particles from fragments of wrappers, filters and the like. The aforediscussed apparatus which is described and shown in the patent to Baier is quite satisfactory for reliable opening of wrappers of unsatisfactory cigarettes.

It has now been found that the rate of delivery of unsatisfactory cigarettes to and the quantity of such cigarettes in the rotary aligning device of the apparatus which is disclosed by Baier are important parameters which determine the economy of the tobacco recovering operation. If the aligning device is overfilled with unsatisfactory cigarettes, the cigarettes are likely to pile up and jam so that the device is incapable of forming a continuous or substantially continuous file of properly aligned unsatisfactory articles. Moreover, such overfilling can adversely affect the opening operation by preventing the articles from assuming a predetermined orientation during transport along the rotary opening implements. Failure of the implements to open a wrapper all the way from the one to the other end will prevent the sifting mechanism from recovering all particles of tobacco from the interior of the respective wrapper.

If the quantity of unsatisfactory articles in the aligning device is insufficient, the wrapper-opening operation is likely to be interrupted and the apparatus is then utilized at less than maximum capacity.

It can also happen that the fillers and/or other constituents of unsatisfactory cigarettes contain hard or very hard substances which are likely to damage or destroy one or more wrapper-engaging (opening) implements. Such hard substances can also enter the rotary aligning device of the aforediscussed patented apparatus to advance into the range of the wrapper-engaging implements between the unsatisfactory articles which form the aforementioned file. Even minor damage to the wrapper-engaging portions of the implements is likely to prevent such implements from opening or breaking the wrappers so that the confined tobacco is not available for segregation from the wrappers downstream of the opening station. In other words, even minor damage to (e.g., breaking away of chips from) the wrapper-engaging portions of the implements can immediately and considerably reduce the efficiency of heretofore known tobacco recovering apparatus.

OBJECTS AND SUMMARY OF THE INVENTION

An object of the invention is to provide a novel and improved apparatus which can recover valuable material from filter cigarettes or other rod-shaped articles of the tobacco processing industry with an at least substantially constant degree of efficiency.

Another object of the invention is to provide an apparatus which can recover tobacco shreds and/or otherwise configurated tobacco particles from unsatisfactory cigarettes or other rod-shaped articles of the tobacco processing industry with the heretofore unmatched degree of reliability, efficiency and reproducibility.

A further object of the invention is to provide the apparatus with novel and improved means for terminating or interrupting its operation in response to detection of one, more, or any one of two or more different malfunctions or defects.

An additional object of the invention is to provide an apparatus which can reliably recover tobacco from a wide variety of rod-shaped smokers' products.

Another object of the invention is to provide the apparatus with novel and improved means for reliably segregating the tobacco particles from filters and/or wrappers of unsatisfactory cigarettes or the like for shorter or longer intervals of time and with the heretofore unexceeded degree of accuracy and reliability.

A further object of the invention is to provide a novel and improved method of regulating the operation of an apparatus which segregates tobacco particles from wrappers and/or other constituents of cigarettes or other types of rod-shaped tobacco-containing articles.

The invention resides in the provision of an apparatus for recovering the contents of particulate fillers of unsatisfactory cigarettes or analogous rod-shaped articles of the type wherein the filler is surrounded by a tubular wrapper. The apparatus comprises means for converting a supply of normally randomly distributed rod-shaped aritcles into a file and transporting the articles of the file along a predetermined path, opening means adjacent to a predetermined portion of the path and including at least one mobile wrapper-breaking implement arranged to open the wrappers of successive articles of the file lengthwise during transport of the respective articles along the aforementioned predetermined portion of the path whereby the implement is likely to undergo damage in the course and as a result of its wrapper-breaking action (e.g., by encountering a hard or very hard fragment in the interior of a wrapper or between the wrappers of successive articles in the file), and means for monitoring the condition of the implement. Such monitoring means includes means for generating a signal on detection of a defect in and/or on the implement. The converting means can comprise a rotary centrifugal aligning device for unsatisfactory articles, and the opening means can comprise a plurality of rotary wrapper-breaking implements. The monitoring means then preferably comprises a discrete signal generating monitoring device (e.g., a photocell) for each implement of the opening means. For example, the opening means can comprise two rotary disc-shaped implements which are disposed in mutually inclined planes preferably making an acute angle and which comprise wrapper-engaging marginal portions. The monitoring means then comprises a discrete monitoring device for each of the two implements. The monitoring device or devices preferably monitor or scan the marginal portion or portions of the implement or implements if the implement or implements are constructed, mounted and operated in such a way that their marginal portions constitute the means for breaking the wrappers of successive unsatisfactory articles in the file. Each monitoring device is preferably out of contact with the respective implement.

The aforementioned rotary centrifugal aligning device preferably comprises suitable means for guiding successive unsatisfactory articles of the file into the range of the opening means. The means for guiding can form part of a belt conveyor which drives the aligning device and/or an edge portion of the aligning device. The latter is preferably rotatable about a vertical axis.

The apparatus further comprises drive means for the implement or implements of the opening means, and such apparatus preferably further comprises means for arresting the drive means in response to generation of a signal by the single monitoring device or by either of two or more monitoring devices. The drive means can include means for operating the converting means (e.g., for rotating the aforementioned rotary centrifugal aligning device), i.e., the converting means is then arrested simultaneously or practically simultaneously with the implement or implements of the opening means as soon as the monitoring means detects that the single implement or at least one implement of the opening means is defective.

The apparatus can further comprise a source of supply of unsatisfactory articles which is designed to feed or includes means for feeding unsatisfactory articles to the aligning device. Such apparatus can further comprise second monitoring means including at least one detector serving to generate second signals denoting the quantity of unsatisfactory articles in at least a portion of the aligning device. Such second signals can be used to interrupt the feed of unsatisfactory articles from the source of supply into the aligning device, e.g., when the quantity of articles in a selected portion of the aligning device is excessive or insufficient. The detector of the second monitoring means is preferably placed adjacent to the aforementioned edge portion of the aligning device. The second monitoring means can comprise a plurality of discrete detectors which are mounted at different distances from the edge portion of the rotating aligning device. Each such detector can include an optoelectronic transducer, and each such transducer can be designed to generate second signals when the quantity of articles in the monitored portion or portions of the aligning device is outside of a predetermined (acceptable) range. As mentioned above, the second signals can be used to actuate a means for interrupting the operation of the source of supply of unsatisfactory articles when the quantity of articles in the monitored portion or portions of the aligning device is outside of such range.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
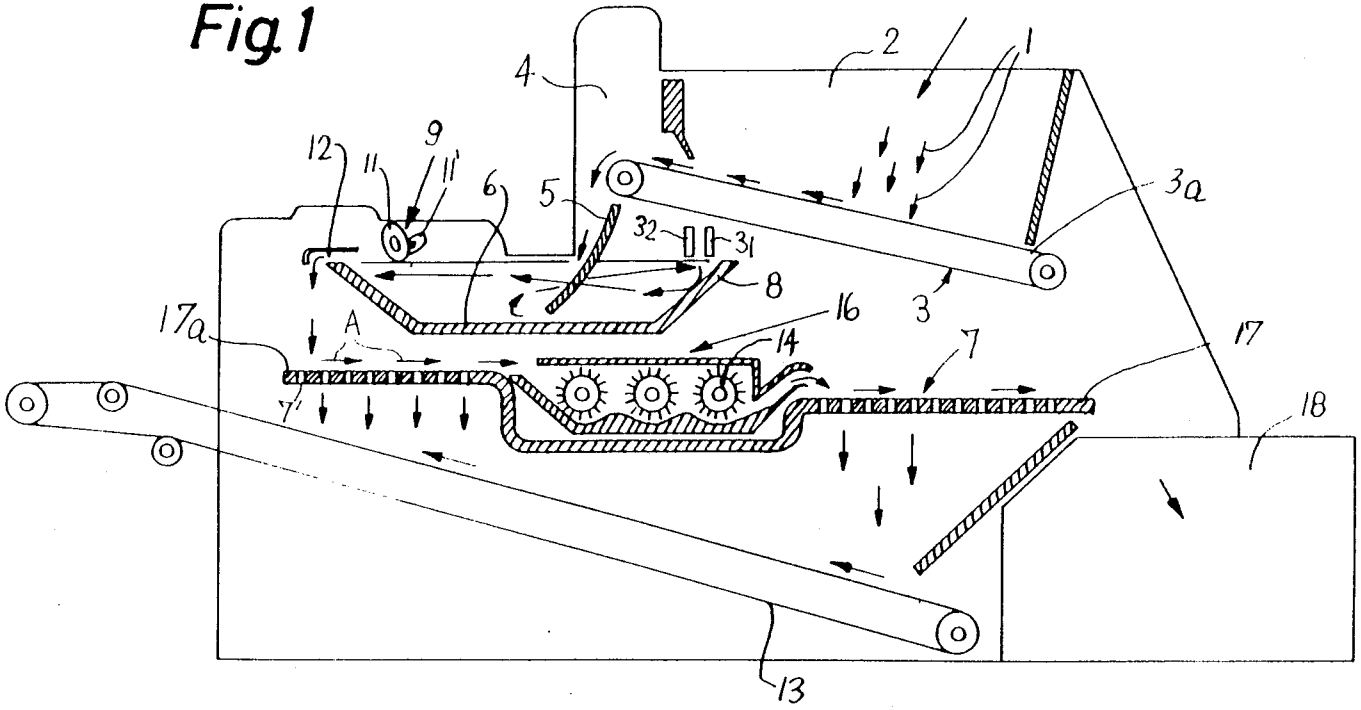
FIG. 1 is a schematic vertical sectional view of an apparatus which embodies the present invention.

FIG. 1 shows a tobacco recovering apparatus including a source of supply of unsatisfactory cigarettes 1 which includes a magazine 2 having a mobile bottom wall 3*a* constituted by the upwardly sloping upper reach of an endless belt conveyor 3. The conveyor 3 delivers randomly distributed unsatisfactory cigarettes 1 into a preclassifying unit 4 which transfers loose tobacco particles, loose fragments of wrappers, loose filters and/or other portions of cigarettes 1 onto the rear portion 17*a* of a vibrating sieve 7 whose orifices or interstices 7' permit particles of tobacco to descend onto the upwardly moving reach of an endless belt conveyor 13 serving to return recovered tobacco to the magazine of a cigarette maker (not shown) or to another destination. Fragments of wrappers, filters and like constituents of cigarettes 1 are advanced in the direction indicated by arrows A.

The magazine 2 can receive unsatisfactory cigarettes 1 from the ejector of a filter tipping machine, e.g., a machine known as MAX-S which is manufactured by the assignee of the present application. The ejector segregates unsatisfactory or potentially unsatisfactory cigarettes from satisfactory or presumably satisfactory cigarettes in response to signals which are generated by a suitable testing device serving to detect frayed or punctured wrappers, wrappers having open seams, filter cigarettes without filters or tobacco-containing portions, tobacco fillers whose ends are too dense or contain less than a minimum acceptable quantity of tobacco, the absence, insufficient or excessive permeability of the so-called ventilating zones in the wrappers, and/or other types of imperfections.

The majority of cigarettes 1 on the upper reach 3*a* of the conveyor 3 descend onto a chute 5 which directs the cigarettes into the central portion of a rotary cup-shaped centrifugal aligning device 6 having a raised circular edge portion 8 serving to convert the randomly distributed cigarettes 1 into a single file along the upper portion of one reach or stretch of an endless belt or band conveyor 19 (see FIG. 2) forming part of drive means for the aligning device 6. The latter rotates about a vertical axis at a level above the vibratory sieve 7.

Successive cigarettes 1 of the single file advance in a guide groove 21 (FIG. 2) which is defined by a straight portion of the aforementioned reach of the conveyor 19 and into contact with the marginal portions 11*a*, 11*a*′ of two driven rotary wrapper-breaking and opening implements 11, 11′ forming part of an opening or breaking device 9. The planes of the disc-shaped implements 11 and 11′ preferably make an acute angle, and the marginal portions 11*a*, 11*a*′ of such implements may but need not be provided with teeth. These marginal portions break the wrappers W of successive cigarettes 1 of the file axially to expose the tobacco fillers as well as the filters. The cigarettes 1 with opened wrappers W enter a channel 12 on their way onto the rear portion 17*a* of the sieve 7. The major portion of tobacco particles immediately enters the orifices 7′ of the sieve 7 and descends onto the conveyor 13. The opened wrappers W and filters advance in the direction of arrows A and enter the range of a series of rapidly rotating carded rollers 14 of an auxiliary recovering device 16. The carding of the rollers 14 beats the opened wrappers W to liberate the fragments of tobacco which are held by the bonded seams and/or which adhere to the internal surfaces of the opened wrappers W for one or more additional reasons (e.g., as a result of excessive application of adhesive to one marginal portion of the running web in the cigarette rod making machine). Tobacco particles which are liberated by the rollers 14 reach the front portion 17 of the vibrating sieve 7 and descend onto the conveyor 13. The opened wrappers, filters and other constituents of cigarettes 1 enter a collecting vessel (e.g., a bin) 18 for waste material.

Figure 2:
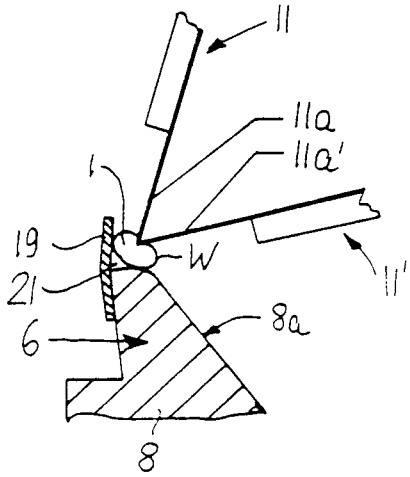
FIG. 2 is an enlarged fragmentary sectional view of the parts at the opening station of the apparatus shown in FIG. 1.

FIG. 2 shows that the marginal portions 11*a*, 11*a*′ of the two rotary implements 11, 11′ engage the wrapper W of an unsatisfactory article 1 in the region opposite, the guide groove 21 which is a narrow space defined by the belt conveyor 19 of the drive means for the aligning device 6 and the circular edge portion 8 of such device. The surface 8*a* of the edge portion 8 slopes upwardly and outwardly toward the upper portion of the conveyor 19, namely, toward that portion which extends upwardly beyond the device 6 to define a substantially straight path along which the articles 1 of the file advance toward and into the range of the opening device 9 including the implements 11 and 11′. The marginal portions 11*a* and 11*a*′ of the two rapidly rotating implements 11 and 11′ actually press a portion of each article 1 into the space 21 at the inner side of the upper portion of the conveyor 19. The peripheral surfaces of the marginal portions 11*a* and 11*a*′ can be in point contact with one another at the locus where they break successive increments of the wrapper W forming part of an unsatisfactory cigarette 1 advancing through the opening station.

Figure 3:
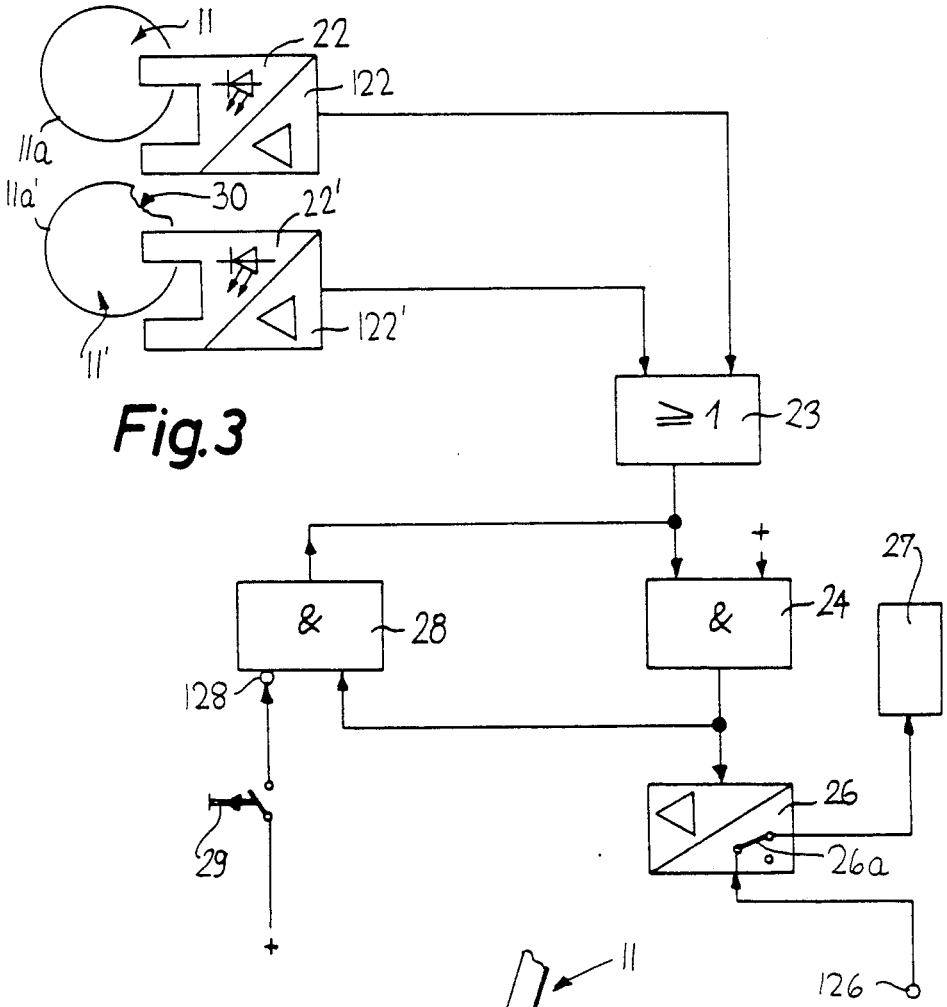
FIG. 3 is a circuit diagram of the means for monitoring the condition of the wrapper-breaking implements at the opening station and of the means for arresting the drive means of the apparatus in response to detection of a defect in or on at least one constituent of the opening means.

FIG. 3 shows that the marginal portions 11*a* and 11*a*′ of the two rotary implements 11 and 11′ are monitored by two discrete bifurcated photocells 22 and 22′ each of which generates a signal in response to detection of a defect on or in the respective marginal portion. The transducers of the photocells 22 and 22′ transmit signals which are amplified at 122, 122′ and are transmitted to the corresponding inputs of an OR gate 23 forming part of a means for arresting a drive 27 for the aligning device 6 and rotary implements 11, 11′ in response to the generation of a signal by the transducer of the photocell 22 or 22′. The arresting means further comprises an AND gate 24 whose left-hand input is connected to the output of the OR gate 23 and whose right-hand input is connected to the positive pole of an energy source, not shown. The arresting means for the drive 27 further comprises a switching circuit 26 having a first input connected with the output of the AND gate 24 and a second input connected with an energy source 126 for the drive 27.

The left-hand input of the AND gate 24 is further connected to the output of a second AND gate 28 the first input of which is connected with the output of the AND gate 24 and the second input of which includes an inverter 128 and is connected with the positive pole of an energy source by a manually operable starting switch 29.

In normal operation of the improved apparatus, the drive 27 transmits motion to the belt 19 which drives the aligning device 6. The drive 27 further transmits torque to the shafts of the rotary implements 11, 11′ of the opening device 9. The implements 11 and 11′ are assumed to be free of defects and, therefore, neither of the two inputs of the OR gate 23 receives a signal from the respective amplifier 122, 122′. Therefore, the switching circuit 26 maintains its switch 26*a* in the illustrated position and thereby connects the energy source 126 with the drive 27 which operates the aligning device 6 as well as the implements 11, 11′ of the opening device 9. However, once the marginal portion of at least one of the implements 11 and 11′ exhibits a defect, the corresponding photocell 22 or 22′ transmits a signal to the associated amplifier 122 or 12″ which, in turn, transmits an amplified signal to the corresponding input of the OR gate 23. FIG. 3 shows that a part of the marginal portion 11*a*, of the implement 11′ is broken away, as at 30, and that such portion is about to enter the range of the photocell 22′. When the transducer of the photocell 22′ transmits signal in response to detection of the defect 30 in the marginal portion 11*a*′ of the implement 11′, the output of the OR gate 23 transmits a signal to the corresponding input of the AND-gate 24 which causes the circuit 26 to open the switch 26*a* and to thus interrupt the connection between the energy source 126 and the drive 27 for the belt conveyor 19 and the implements 11 and 11'. If desired, the signal at the output of the OR gate 23, AND gate 24, amplifier 122 or amplifier 122' can also activate a device for the generation of visible, audible and/or otherwise detectable signals in order to warn the attendant or attendants 15 that one of the implements 11, 11' at the station including the opening device 9 requires inspection or replacement.

The output of the AND gate 24 further transmits a signal to the corresponding input of the second AND gate 28. The other input of the AND gate 28 also receives a signal because the switch 29 is then open and such input of the gate 28 includes the inverter 128 which generates a signal when the switch is open. The inverter 128 prevents the transmission of a signal to the corresponding input of the gate 28 when the switch 29 is closed by an attendant. The output of the AND gate 28 then transmits a signal to the left-hand input of the AND gate 24 as long as the switch 29 remains open. Thus, the AND gate 28 ensures that the drive 27 for the belt 19 and the implements 11, 11' remains idle while the attendant replaces the defective implement 11' with a fresh implement. Once the replacement is completed, the attendant closes the switch 29 which interrupts the transmission of a signal from the output of the AND gate 28 to the corresponding input of the AND gate 24 so that the output of the AND gate 24 ceases to transmit a signal to the circuit 26, i.e., the switch 26*a* reassumes the illustrated position and the source 126 is again connected with the drive 27.

Figure 4:
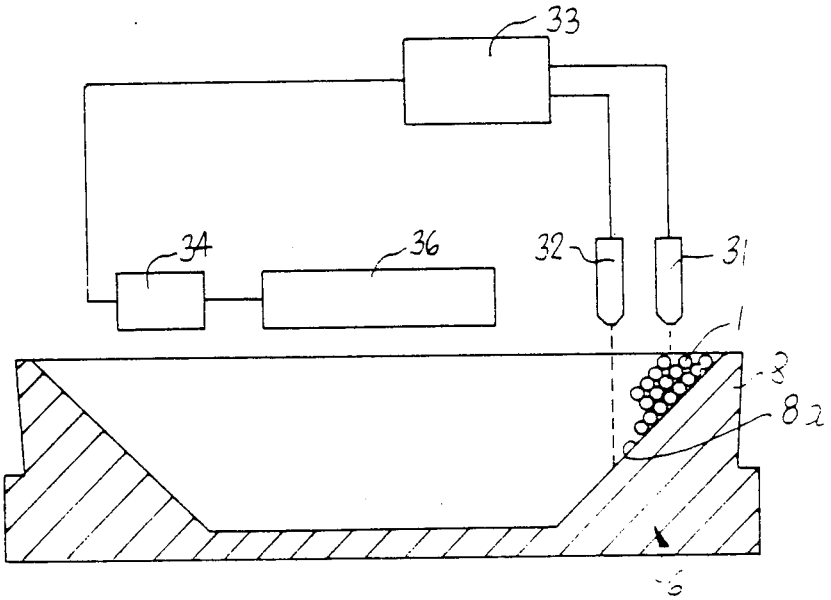
FIG. 4 is a circuit diagram of the means for monitoring the supply of unsatisfactory articles in or on the transporting means which delivers unsatisfactory articles to the opening station.

FIG. 4 shows a second monitoring device including two photoelectric detectors 31 and 32 which monitor the quantities of unsatisfactory cigarettes 1 in selected portions of the interior of the rotating centrifugal aligning device 6, namely, in two portions which are close to but are located at different distances from the edge portion 8, as considered radially of the device 6. As the device 6 rotates, the cigarettes 1 which are supplied to its central portion via chute 5 (FIG. 1) move radially outwardly under the action of centrifugal force and gather along the outwardly and upwardly inclined inner side 8*a* of the edge portion 8. The movements of cigarettes 1 under the action of centrifugal force result in alignment of cigarettes in the region of the edge portion 8, i.e., the cigarettes which reach or are close to the inner side 8*a* of the edge portion 8 are at least substantially parallel to each other on their way toward the inner side of the belt conveyor 19 (not shown in FIG. 4).

The detectors 31 and 32 generate signals whose intensity and/or another characteristic is indicative of the detected quantity of cigarettes 1 in the respective portion of the device 6, and such signals are transmitted to a signal processing control circuit 33 which, in turn, is connected with the drive means 34 for the means 36 (e.g., including the magazine 2 and belt 3 of FIG. 1) for supplying unsatisfactory cigarettes 1 to the device 6.

If the drive 27 rotates the aligning device 6 while the drive 34 for the source 36 of unsatisfactory cigarettes 1 is idle, the circuit 33 continues to deactivate the drive 34 for the source 36 as long as each of the detectors 31, 32 generates a signal denoting that the corresponding (monitored) portion of the interior of the aligning device 6 contains more than a minimum permissible quantity of unsatisfactory cigarettes 1. The source 36 continues to remain idle if the inner detector 32 generates a signal denoting the absence of cigarettes 1 therebelow or an insufficient quantity of cigarettes in the corresponding portion of the device 6, as long as the signals from the outer detector 31 indicate that the quantity of articles 1 in the corresponding portion of the device 6 exceeds the minimum acceptable quantity. The circuit 33 causes the drive 34 to restart the source 36 if each of the detectors 31, 32 transmits a signal denoting that the corresponding portion of the aligning device 6 contains an insufficient quantity of unsatisfactory articles 1, e.g., that each such portion of the device 6 is empty.

If the drive 34 is on so that the source 36 supplies articles 1 to the aligning device 6, the circuit 33 ensures that the drive 34 remains on as long as each of the detectors 31, 32 indicates that the corresponding portion of the device 6 contains less than the minimum acceptable quantity of cigarettes 1. If the detector 32 continues to transmit a signal denoting that the corresponding portion of the device 6 contains less than the minimum acceptable quantity of cigarettes 1 but the outer detector 31 transmits a signal denoting that the respective portion of the device 6 contains an adequate supply of cigarettes, the drive 34 remains on. The drive 34 is arrested when each of the detectors 31, 32 transmits a signal denoting that the corresponding portion of the device 6 contains an adequate quantity of cigarettes 1. The detectors 31 and 32 can be readily designed (or the circuit 33 can be readily constructed) in such a way that the drive 34 is arrested whenever the quantity of cigarettes 1 in the monitored portion or portions of the aligning device 6 is outside (above or below) a predetermined acceptable range.

An important advantage of the improved apparatus is that it ensures reliable segregation of maximum quantities of tobacco particles from unsatisfactory cigarettes 1 for a number of reasons. Thus, the rate of recovery of tobacco particles from unsatisfactory cigarettes does not fluctuate due to in part satisfactory and in part less satisfactory operation of the parts of the apparatus; the only reason for fluctuations in the output of the apparatus (as concerns the quantity of tobacco particles on the conveyor 13) is the fluctuation of quantities of tobacco particles in the articles 1 which are being processed.

The reliability of the apparatus is enhanced because the opening device 9 always operates in an optimum manner since any and all noticeable flaws of the implement or implements that open the wrappers W of the cigarettes 1 are detected practically instantaneously, and such detection results in stoppage of the aligning device 6 and implements 11, 11' so that the apparatus cannot deliver improperly opened cigarettes 1 onto the screen 7. The reliability of operation is further enhanced because the aligning device 6 ceases to receive unsatisfactory cigarettes 1 from the source 36 as soon as the quantity of cigarettes in its interior is such that the device 6 is not likely to form a satisfactory file of discrete rod-shaped articles for transport to the opening station. It has been found that the percentage of tobacco particles which enter the bin 18 is surprisingly low, i.e., that the improved apparatus operates with a degree of efficiency which cannot be matched by heretofore known apparatus.

During the intervals of idleness of the drive 27, which are required to replace a defective implement with a fresh implement, the aligning device 6 simply remains at a standstill so that unopened cigarettes 1 cannot descend onto the sieve 7 and cannot enter the bin 18. Detection of a defect in or on the implement 11 and/or 11' is practically instantaneous, and the reaction of the arresting means 23, 24, 26 for the drive 27 is also instantaneous. This contributes significantly to a more satisfactory rate of recovery of tobacco particles from the unsatisfactory cigarettes 1.

The detectors 31, 32 or analogous monitoring means ensure that the quantity of cigarettes 1 in the interior of the aligning device 6 (or at least in the monitored portion or portions of the aligning device) cannot drop below a preselected minimum value which would entail an interruption of the wrapper-opening operation, or increase beyond an acceptable maximum value which would interfere with proper delivery of cigarettes into the range of the implements 11 and 11' or analogous implements. All in all, the improved apparatus operates with a high degree of efficiency, and its operation is automated so that it requires a minimum of attention, not only as regards the operation and condition of the implements at the opening station, but also as concerns the delivery of unsatisfactory cigarettes to the aligning device 6.

The improved apparatus is susceptible of many further modifications without departing from the spirit of the invention. For example, the detectors 31, 32 can be omitted, especially if the centrifugal aligning device 6 is replaced with otherwise operated means for converting a mass of randomly distributed unsatisfactory or presumably unsatisfactory rod-shaped articles into a file and for transporting the articles of such file lengthwise into the range of one or more wrapper-opening implements. Also, the means for arresting the drive 27 can be omitted if the photocells 22, 22' are designed to generate visually and/or otherwise detectable signals so as to warn the attendants that the implement 11 and/or 11' requires replacement. All such and many other modifications will be readily comprehended by persons skilled in this art without the need for additional illustrations.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for recovering the contents of particulate fillers of unsatisfactory cigarettes or analogous rod-shaped articles of the type wherein the filler is surrounded by a tubular wrapper, comprising means for converting a supply of unsatisfactory articles into a file and transporting successive articles of the file along a predetermined path, said converting means comprising a rotary centrifugal aligning device having an edge portion arranged to form and transport said file of unsatisfactory articles to said aligning device; opening means adjacent to a predetermined portion of said path and including at least one mobile wrapper-breaking implement arranged to open the wrappers of successive unsatisfactory articles lengthwise during transport of such articles along said protion of said path, said implement being likely to undergo damage in the course and as a result of its wrapper-breaking action; first means for monitoring the condition of said implement, including means for generating a first signal on detection of a defect in or on said implement, said monitoring means being out of contact with said implement; and second monitoring means including a plurality of optoelectronic transducers disposed at different distances from said edge portion of said aligning device and arranged to generate second signals denoting the quantity of unsatisfactory articles in at least a portion of said aligning device.

2. The apparatus of claim 1, wherein said opening means includes a plurality of mutually inclined rotary wrapper-breaking implements and said first monitoring means comprises a discrete signal generating monitoring device for each of said implements.

3. The apparatus of claim 1, wherein said converting means includes means for guiding successive unsatisfactory articles of said file along said path.

4. The apparatus of claim 1, wherein said opening means includes two rotary disc-shaped implements disposed in mutually inclined planes making an acute angle and having wrapper-engaging marginal portions, monitoring means including a discrete signal generating monitoring device for each of said implements.

5. The apparatus of claim 1, wherein said implement is a rotary implement having a wrapper-engaging marginal portion and said first monitoring means includes a device which is arranged to monitor the marginal portion of said implement.

6. The apparatus of claim 1, wherein said first monitoring means comprises a photocell.

7. The apparatus of claim 1, further comprising drive means for said implement and means for arresting said drive means in response to said first signal.

8. The apparatus of claim 7, wherein said drive means includes means for operating said converting means so that said converting means is arrested at least substantially simultaneously with said implement.

9. The apparatus of claim 1, wherein said detector are adjacent said edge portion of said aligning device.

10. The apparatus of claim 1, wherein said transducers include means for generating second signals when the quantity of articles in the monitored portion of said aligning device is outside of a predetermined range.

11. The apparatus of claim 1, further comprising means for interrupting the operation of said source of supply when the quantity of unsatisfactory articles in the monitored portion of said aligning device is outside of a predetermined range.

* * * * *